US005652090A

United States Patent [19]

Lok

[11] Patent Number: 5,652,090

[45] Date of Patent: Jul. 29, 1997

[54] SILVER HALIDE PHOTOGRAPHIC ELEMENTS CONTAINING DITHIOLONE COMPOUNDS

[75] Inventor: Roger Lok, Rochester, N.Y.

[73] Assignee: Eastman Kodak Company, Rochester, N.Y.

[21] Appl. No.: 616,825

[22] Filed: Mar. 15, 1996

[51] Int. Cl.[6] ..... G03C 1/09

[52] U.S. Cl. ..... 430/569; 430/611; 430/614

[58] Field of Search ..... 430/569, 611, 430/614

[56] References Cited

U.S. PATENT DOCUMENTS

| | | | |
|---|---|---|---|
| 2,440,110 | 4/1948 | Mueller . | |
| 2,440,206 | 4/1948 | Mueller . | |
| 3,043,696 | 7/1962 | Herz et al. . | |
| 3,047,393 | 7/1962 | Herz et al. . | |
| 3,057,725 | 10/1962 | Herz et al. . | |
| 3,226,232 | 12/1965 | Dersch et al. . | |
| 3,397,986 | 8/1968 | Millikan et al. . | |
| 3,447,925 | 6/1969 | Dersch et al. . | |
| 3,761,277 | 9/1973 | Vandenberghe et al. . | |
| 4,788,132 | 11/1988 | Deguchi et al. | 430/505 |
| 4,861,703 | 8/1989 | Lok et al. | 430/608 |
| 4,960,689 | 10/1990 | Nishikawa et al. | 430/603 |
| 5,116,723 | 5/1992 | Kajiwara et al. | 430/611 |
| 5,217,859 | 6/1993 | Boettcher et al. | 430/569 |
| 5,219,721 | 6/1993 | Klaus et al. | 430/569 |
| 5,356,770 | 10/1994 | Lok et al. | 430/611 |
| 5,364,754 | 11/1994 | Kim et al. | 430/569 |
| 5,415,992 | 5/1995 | Lok | 430/610 |
| 5,443,947 | 8/1995 | Lok | 430/569 |

*Primary Examiner*—Mark F. Huff
*Attorney, Agent, or Firm*—Sarah Meeks Roberts

[57] ABSTRACT

This invention provides a silver halide photographic element comprising a silver halide emulsion in reactive association with a dithiolone compound represented by the following formula:

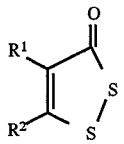

wherein $R^1$ and $R^2$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, sulfo groups, or amino groups, or $R^1$ and $R^2$ together represent the atoms necessary to form a five or six-membered ring or a multiple ring system. This invention further provides a method of making silver halide emulsions containing the dithiolone compounds.

20 Claims, No Drawings

SILVER HALIDE PHOTOGRAPHIC ELEMENTS CONTAINING DITHIOLONE COMPOUNDS

FIELD OF THE INVENTION

This invention relates to the use of certain dithiolone compounds as stabilizers in silver halide photographic elements and the preparation of silver halide emulsions containing such compounds.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog is usually expressed as "D-min", the density obtained in the unexposed portions of the emulsion. Density, as normally measured, includes both that produced by fog and that produced as a function of exposure to light. It is known in the art that the appearance of photographic fog related to intentional or unintentional reduction of silver ion (reduction sensitization) can occur during many stages of preparation of the photographic element including silver halide emulsion preparation, spectral/chemical sensitization of the silver halide emulsion, melting and holding of the liquid silver halide emulsion melts, subsequent coating of silver halide emulsions, and prolonged natural and artificial aging of coated silver halide emulsions. The chemicals used for preventing fog growth as a result of aging or storage are generally known as emulsion stabilizers.

The control of fog has been attempted by a variety of means. Thiosulfonates and thiosulfonate esters, such as those described in U.S. Pat. Nos. 2,440,206; 2,934,198; 3,047,393; and 4,960,689, and organic dichalcogenides, for example, the disulfide compounds described in U.S. Pat. Nos. 3,447,925; 2,440,110; 3,043,696; 3,057,725; 3,226,232; 3,397,986; 3,761,277; and 4,788,132 have been used to prevent the formation of fog in silver halide elements. Organic compounds having a polysulfur linkage comprised of three or more sulfur atoms, and organic compounds having a heterocyclic ring having at least two thioether linkages or at least one disulfur linkage, such as those described in U.S. Pat. No. 5,116,723, have also been discussed as suppressing fog and improving raw stock stability when used in combination with nitrogen-containing cyclic compounds.

Photographic emulsions that have a high silver chloride content are particularly prone to fog increase due to high temperature and humidity during storage. These changes may vary from layer to layer resulting in color imbalance and a loss of quality of the print material.

High chloride content color print paper also has an undesirable sensitivity to temperature changes during exposure. For example, when the temperature upon exposure rises due to heat from the exposing element during printing, the print density changes if the printing conditions are left at the initial set values. This may result in prints varying in density that were exposed at the normal temperature. Very often, an increase in temperature during exposure of the paper may result in a selective increase in speed in one layer, for instance the cyan layer, over another light sensitive layer such as the magenta layer. Such speed variation results in improper color balance of the color print, and requires the photofinisher to readjust his printing conditions in order to compensate for this density fluctuation. This results in a loss in operating efficiency.

Various methods have been described to reduce the temperature sensitivity of high silver chloride color paper materials. EP 0 367,227 (1988) discusses employing certain spectral sensitizing dyes in combination with mercapto azoles; and EP 0 325,235 describes using iron ion donating compounds in high chloride photographic elements to reduce their change in sensitivity due to exposure at elevated temperature. Other methods for improving heat stability are described in U.S. Pat. Nos. 5,443,947; 5,415,992; and 5,356,770.

Despite the vast amount of effort which has gone into methods to control fog in photographic elements there is a continuing need in the industry for practical and environmentally benign stabilizers which do not otherwise adversely affect the performance of the photographic element. There further remains a continuing need for an effective means for heat stabilizing high chloride emulsions against thermal changes.

SUMMARY OF THE INVENTION

This invention provides a silver halide photographic element comprising a silver halide emulsion in reactive association with a thiolone compound represented by the following formula:

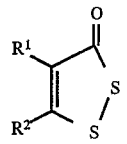

wherein $R^1$ and $R^2$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, sulfo groups, or amino groups, or $R^1$ and $R^2$ together represent the atoms necessary to form a five or six-membered ring or a multiple ring system.

In one embodiment, the silver halide emulsion is greater than 90 mole % silver chloride. This invention also provides a method of making a silver halide emulsion comprising the dithiolone compounds described above.

The silver halide photographic elements of this invention exhibit reduced fog and reduced heat sensitivity. The thiolone compounds used in this invention are commercially available and they may be used in combination with other antifoggants and stabilizers. Further, such compounds may be added at any stage of the preparation of the emulsion.

DETAILED DESCRIPTION OF THE INVENTION

The compounds of this invention are thiolone compounds represented by the following Formula I:

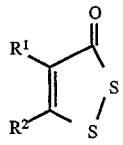

(I)

$R^1$ and $R^2$ can be any substituents which are suitable for use in a silver halide photographic element and which do not interfere with the stabilizing activity of the thiolone compound. $R^1$ and $R^2$ may be independently H, or a substituted or unsubstituted aliphatic, aromatic, or heterocyclic group or $R^1$ and $R^2$ may together represent the atoms necessary to form a ring or a multiple ring system. $R^1$ and $R^2$ may also be alkoxy groups (for example, methoxy, ethoxy, octyloxy), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acyloxy groups (for example, acetoxy, benzoxy), carboxyl groups, cyano groups, sulfo groups, and amino groups.

When $R^1$ and $R^2$ are aliphatic groups, preferably, they are alkyl groups having from 1 to 22 carbon atoms, or alkenyl or alkynyl groups having from 2 to 22 carbon atoms. More preferably, they are alkyl groups having 1 to 8 carbon atoms, or alkenyl or alkynyl groups having 3 to 5 carbon atoms. These groups may or may not have substituents. Examples of alkyl groups include methyl, ethyl, propyl, butyl, pentyl, hexyl, octyl, 2-ethylhexyl, decyl, dodecyl hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms and include, among others, phenyl and naphthyl groups. More preferably, the aromatic groups have 6 to 10 carbon atoms. These groups may have substituent groups. The heterocyclic groups are 3 to 15-membered rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

Preferably, $R^1$ and $R^2$ together form a ring or multiple ring system. These ring systems may be unsubstituted or substituted. The ring and multiple ring systems formed by $R^1$ and $R^2$ may be alicyclic or they may be the aromatic and heterocyclic groups described above. In a preferred embodiment, $R^1$ and $R^2$ together form a 5 or 6-membered ring, preferably, an aromatic ring. Most preferably, the thiolone compound is 3H-1,2-benzodithiol-3-one (Compound A1).

Nonlimiting examples of substituent groups for $R^1$ and $R^2$ include alkyl groups (for example, methyl, ethyl, hexyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups. Preferred substituents are lower alkyl groups, i.e., those having 1 to 4 carbon atoms (for example, methyl) and halogen groups (for example, chloro). Specific examples of the dithiolic compounds include, but are not limited to:

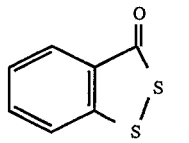
A1

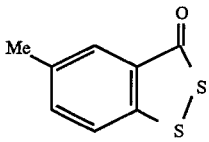
A2

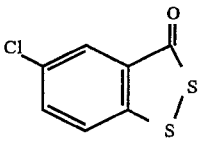
A3

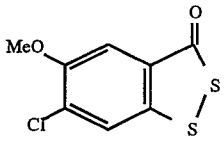
A4

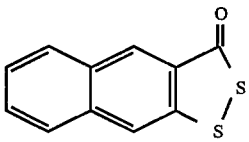
A5

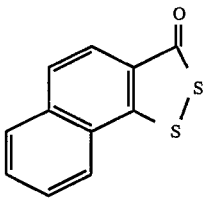
A6

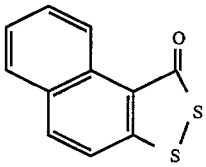
A7

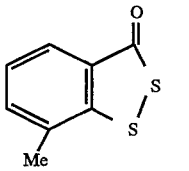
A8

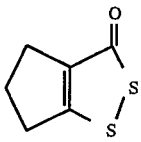
A9

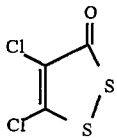
A10

-continued

A11

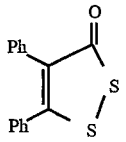

A12

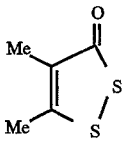

A13

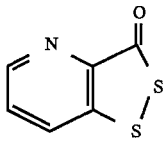

A14

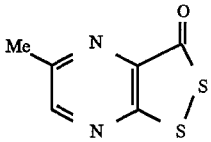

A15

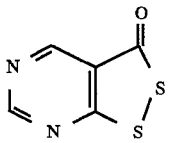

A16

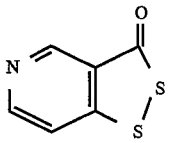

A17

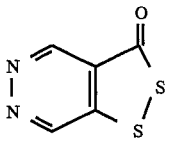

A18

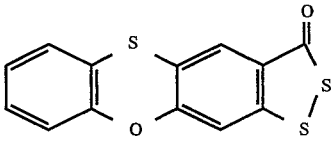

A19

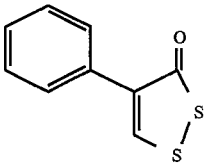

A20

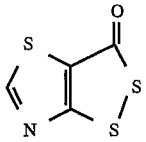

-continued

A21

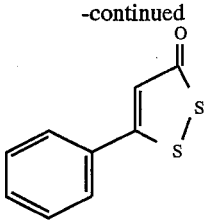

A22

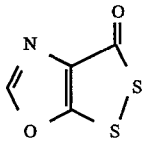

It is understood throughout this specification and claims that any reference to a substituent by the identification of a group or a ring containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention.

One method of preparing an aromatic 3H-1,2-dithiol-3-one is via the cyclization of an ortho substituted aryl mercaptocarboxylic acid in the presence of thiolacetic acid as described in OPPI Briefs 24, #4, 488 (1992), or in J. Org. Chem., 55, #15, 4698, (1990), incorporated herein by reference. Alternatively, the treatment of phenylpropiolic chloride with hydrogen disulfide and zinc chloride in benzene also gives good yields of the heterocycle (see Angewandte Chemie 69, p. 138, 1957, also incorporated herein by reference). Some thiolone compounds may be purchased commercially.

Useful levels of the thiolone compounds range from 0.001 mg to 1000 mg per silver mole. The preferred range is from 0.01 mg to 500 mg per silver mole with a more preferred range being from 0.1 mg to 100 mg per silver mole. The most preferred range is from 1 mg to 50 mg per silver mole.

The compounds of this invention may be added to the photographic emulsion using any technique suitable for this purpose. They may be dissolved in most common organic solvents, for example, methanol or acetone. The thiolone compounds can be added to the emulsion in the form of a liquid/liquid dispersion similar to the technique used with certain couplers. They can also be added as a solid particle dispersion.

The dithiolone compounds may be added to any layer where they are in reactive association with the silver halide. By "in reactive association with" it is meant that the compounds must be contained in the silver halide emulsion layer or in a layer whereby they can react, interact, or come in contact with the silver halide emulsion. For example, the compounds can also be added to gelatin-only overcoats or interlayers.

The dithiolone compounds may be used in addition to any conventional emulsion stabilizer or antifoggant as commonly practiced in the art. Combinations of more than one dithiolone compound may be utilized.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be any of those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The compounds of this invention may be added to the silver halide emulsion at any time during the preparation of the emulsion, i.e., during precipitation, during or before chemical sensitization or during final melting and co-mixing of the emulsion and additives for coating. Most preferably, these compounds are added during or after chemical sensitization.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The compounds of this invention are particularly useful with intentionally or unintentionally reduction sensitized emulsions. As described in *The Theory of the Photographic Process,* Fourth Edition, T. H. James, Macmillan Publishing Company, Inc., 1977 pages 151–152, reduction sensitization has been known to improve the photographic sensitivity of silver halide emulsions. While reduction sensitized silver halide emulsions generally exhibit good photographic speed they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979). Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 A1 (Yamada), and EP 0 435355 A1 (Makino).

The method of this invention is also particularly useful with emulsions doped with Group VIII metals such as iridium, rhodium, osmium, and iron as described in *Research Disclosure,* September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

The photographic elements suitable for use with this invention may be simple single layer elements or multilayer, multicolor elements. They may also be black and white elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art. The silver halide elements may be reversal or negative elements (including color paper).

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as described in *Research Disclosure,* November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure,* December 1978, Item 17643, (2) *Research Disclosure,* December 1989, Item 308119, and (3) *Research Disclosure,* September 1994, Item 36544, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including hardeners, coating |
| 3 | I, II, III, IX A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Wash-out |
| 3 | X | couplers; Dye stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |

-continued

| Reference | Section | Subject Matter |
|---|---|---|
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) process or other processing systems suitable for developing high chloride emulsions.

The following examples illustrate the practice of this invention. They are not intended to be exhaustive of all possible variations of the invention.

EXAMPLES

Example 1

In accordance with the present invention, a 0.054 mole of a cubic negative silver chloride emulsion sensitized with a colloidal suspension of aurous sulfide (3.9 mg/Ag mol), a blue spectral sensitizing dye, anhydro-5-chloro-3,3'-di(3-sulfopropyl) naphtho[1,2-d] thiazolothiacyanine hydroxide triethylammonium salt (220 mg/Ag mol), potassium bromide (741 mg/Ag mol) and 1-(3-acetamidophenyl)-5-mercaptotetrazole (68 mg/Ag mol) was treated with a solution of Compound (A1) dissolved in acetone in an amount indicated in Table 1. This emulsion further contained a yellow dye-forming coupler alpha-(4-(4-benzyloxy-phenylsulfonyl)phenoxy)-alpha(pivalyl)-2-chloro-5-(gamma-(2,4-di-5-amylphenoxy)butyramido)acetanilide (1.08 g/m$^2$) in di-n-butylphthalate coupler solvent (0.27 g/m$^2$), and gelatin (1.51 g/m$^2$). The emulsion (0.34 g Ag/m$^2$) was coated on a resin coated paper support and a 1.076 g/m$^2$ gel overcoat was applied as a protective layer along with the hardener bis (vinylsulfonyl) methyl ether in an amount of 1.8% of the total gelatin weight. The coatings were then stored at 0° F., and 120° F. for one and two weeks.

The coatings were given a 0.1 second exposure, using a 0–3 step tablet (0.15 increments) with a tunsten lamp designed to stimulate a color negative print exposure source. This lamp had a color temperature of 3000° K., log lux 2.95, and the coatings were exposed through a combination of magenta and yellow filters, a 0.3 ND (Neutral Density) filter, and a UV filter. The processing consisted of color development (45 sec, 35° C.), bleach-fix (45 sec, 35° C.) and stabilization or water wash (90 sec, 35° C.) followed by drying (60 sec, 60° C.). The chemistry used in the Colenta processor consisted of the following solutions:

| | |
|---|---|
| Developer | |
| Lithium salt of sulfonated polystyrene | 0.25 mL |
| Triethanolamine | 11.0 mL |
| N,N-diethylhydroxylamine (85% by wt.) | 6.0 mL |
| Posassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequesteting agent | 0.8 mL |
| Potassium carbonate | 25.0 g |
| Water to total of 1 liter, pH adjusted to 0.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2 | |

The speed, as measured at the 1.0 density point of the D log E curve, was used as the sensitivity measurement of the emulsion. Heat sensitivity data was obtained on a sensitometer which was modified with a water jacket so that the temperature of the step tablet could be maintained at 22° C., or increased to 40° C. The change in speed due to the temperature variation (ΔSpeed/HS) was also calculated at the 1.0 density point.

The data in Table I show the speed of the blue sensitized coatings kept at 0° F. and the changes in speed after a one and a two-week storage at 120° F.

TABLE I

| Sample | mg (A1) Ag mol | 1 week ΔSpeed | 2 week ΔSpeed | ΔSpeed/HS |
|---|---|---|---|---|
| 1 (control) | 0 | 8.9 | 13.7 | 4.6 |
| 2 (invention) | 300 | 3.9 | 5.6 | 0.7 |
| 3 (invention) | 900 | 0.0 | 0.6 | 0.2 |
| 4 (invention) | 1500 | −1.2 | −2.4 | −2.3 |

It can be seen in Table I that upon storage, inventive Samples 2–4 have less speed increase than the control Sample 1. It is also clear that the coatings with Compound (A1) of the present invention have less sensitivity to temperature changes during exposure (smaller change in ΔSpeed/HS) than the control sample.

Example 2

In this example, the stabilizing effect of compound (A1) is seen in an iodochloride emulsion. A cubic silver chloride negative emulsion was prepared and sensitized as in Example 1 except that 0.03% iodide was introduced in the course of the precipitation of the emulsion. Compound (A1) was added to this emulsion, as before, just prior to coating, and the coatings were stored, exposed and processed as in Example 1.

The data in Table II show the fog density of the blue sensitized coatings kept at 0° F. and the changes in fog density after a one and a two-week storage at 120° F. Fog is measured as the minimum density (Dmin) above zero.

TABLE II

| Sample | mg (A1) Ag mol | 0° F. Fog | 1 week ΔFog | 2 week ΔFog |
|---|---|---|---|---|
| 5 (control) | 0 | 0.113 | 0.032 | 0.104 |
| 6 (invention) | 10 | 0.113 | 0.028 | 0.102 |
| 7 (invention) | 20 | 0.112 | 0.025 | 0.101 |
| 8 (invention) | 100 | 0.109 | 0.023 | 0.082 |
| 9 (invention) | 400 | 0.104 | 0.021 | 0.074 |

It can be seen in Table II that the stabilizing activity of Compound (A1) of the present invention has resulted in lower fog growth after storage for inventive Samples 6–9 than for control Sample 5.

Example 3

In this example a 0.3 mole cubic negative silver chloride emulsion was sensitized with a colloidal suspension of aurous sulfide (17.6 mg/Ag mol) at 40° C. The emulsion was heated to 65° C. at a rate of 10° C. per 6 minutes and then held at this temperature for 60 minutes. During this time, 1-(3-acetamidophenyl)-5-mercaptotetrazole (298 mg/Ag mol), potassium hexachloroiridate (0.24 mg/Ag mol) and potassium bromide (1372 mg/Ag mol) were added. The emulsion was cooled back to 40° C. at a rate of 10° C. per 6 minutes, at which time, a red spectral sensitizing dye, anhydro-3-ethyl-9,11-neopentylene-3'-(3-sulfopropyl) thiadicarbocyanine hydroxide (22 mg/Ag mol), was added and the pH of the emulsion was adjusted to 6.0. The emulsion also contained a cyan dye-forming coupler 2-(alpha (2,4-di-tert-amyl-phenoxy)butyramido)-4,6-dichloro-5-ethyl phenol (0.42 g/m$^2$) in di-n-butyl phthalate coupler solvent (0.429 g/m$^2$) and gelatin (1.08g/m$^2$). Compound (A1) was dissolved in acetone and added to the emulsion (in the amount indicated in Table III) just prior to coating. The emulsion (0.18 g Ag/m$^2$) was coated on a resin coated paper support and a 1,076 g/m$^2$ gel overcoat was applied as a protective layer along with the hardener bis (vinylsulfonyl) methyl ether in an amount of 1.8% of the total gelatin weight. These coatings were stored, exposed and processed as in Example 1.

The data in Table III show that inventive Samples 11–13 exhibit much less fog than control Sample 10. Thus the compounds of this invention are advantageous in controlling fog growth regardless of how the emulsion is spectrally (blue or red) sensitized.

TABLE III

| Sample | mg (A1) Ag mol | 0° F. Fog | 1 week ΔFog | 2 week ΔFog |
|---|---|---|---|---|
| 10 (control) | 0 | 0.130 | 0.043 | 0.149 |
| 11 (invention) | 300 | 0.126 | 0.038 | 0.117 |
| 12 (invention) | 600 | 0.126 | 0.035 | 0.108 |
| 13 (invention) | 900 | 0.127 | 0.030 | 0.080 |

Example 4

In this example the emulsion was prepared as in Example 1 except the emulsion was a tabular [100] grain negative silver chloride emulsion. The compound of the present invention, Compound (A1), and a comparison compound, Compound (CC), were added at 0.04 mmol per silver mole to separate portions of the emulsion during the sensitization process just prior to addition of the aurous sulfide sensitizer. The coatings were exposed and processed as in Example 1.

TABLE IV

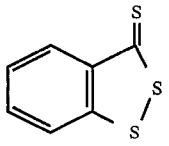

(CC)

| Sample | Compound | Fresh Fog | Fresh Speed |
|---|---|---|---|
| 14 (comparison) | none | 0.122 | 165 |
| 15 (comparison) | (CC) | 1.469 | NL |
| 16 (invention) | (A) | 0.111 | 168 |

NL = not legible

It is clear from data in Table IV that even without the accelerated keeping conditions, the comparison Compound (CC) gives gross fog and little speed.

The invention has been described in detail with particular reference to the preferred embodiments thereof, but it will be understood that variations and modifications can be effected within the scope of the invention.

What is claimed is:

1. A silver halide photographic element comprising a silver halide emulsion in reactive association with a dithiolone compound represented by the following formula:

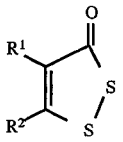

wherein $R^1$ and $R^2$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, sulfo groups, or amino groups, or $R^1$ and $R^2$ together represent the atoms necessary to form a five or six-membered ring or a multiple ring system.

2. The silver halide photographic element of claim 1 wherein $R^1$ and $R^2$ together represent the atoms necessary to form a five or six-membered ring or a multiple ring system.

3. The silver halide photographic element of claim 2 wherein $R^1$ and $R^2$ together represent the atoms necessary to form a five or six-membered ring.

4. The silver halide photographic element of claim 3 wherein the dithiolone compound is 3H-1,2-benzodithiol-3-one.

5. The silver halide photographic element of claim 1 wherein the silver halide emulsion is greater than 50 mole % silver chloride.

6. The silver halide photographic element of claim 3 wherein the silver halide emulsion is greater than 50 mole % silver chloride.

7. The silver halide photographic element of claim 1 wherein the silver halide emulsion is greater than 90 mole % silver chloride.

8. The silver halide photographic element of claim 3 wherein the silver halide emulsion is greater than 90 mole % silver chloride.

9. The silver halide photographic element of claim 1 wherein the concentration of the dithiolone compound is from 0.1 to 100 mg/mol Ag.

10. The silver halide photographic element of claim 3 wherein the concentration of the dithiolone compound is from 0.1 to 100 mg/mol Ag.

11. The silver halide photographic element of claim 8 wherein the concentration of the dithiolone compound is from 0.1 to 100 mg/mol Ag.

12. The silver halide photographic element of claim 11 wherein the dithiolone compound is 3H-1,2-benzodithiol-3-one.

13. A method of making a silver halide emulsion comprising precipitating and chemically sensitizing the emulsion and further comprising adding to the emulsion at any time during its preparation a dithiolone compound represented by the following formula:

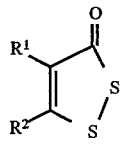

wherein $R^1$ and $R^2$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, sulfo groups, or amino groups, or $R^1$ and $R^2$ together represent the atoms necessary to form a five or six-membered ring or a multiple ring system.

14. The method of claim 13 wherein $R^1$ and $R^2$ together represent the atoms necessary to form a five or six-membered ring.

15. The method of claim 14 wherein the dithiolone compound is 3H-1,2-benzodithiol-3-one.

16. The method of claim 13 wherein the silver halide emulsion is greater than 90 mole % silver chloride.

17. The method of claim 14 wherein the silver halide emulsion is greater than 90 mole % silver chloride.

18. The method of claim 13 wherein the amount of the dithiolone compound added is from 0.1 to 100 mg/mol Ag.

19. The method of claim 14 wherein the amount of the dithiolone compound added is from 0.1 to 100 mg/mol Ag.

20. The method of claim 16 wherein the amount of the dithiolone compound added is from 0.1 to 100 mg/mol Ag.

* * * * *